US007185453B2

(12) United States Patent
Spear et al.

(10) Patent No.: US 7,185,453 B2
(45) **Date of Patent: *Mar. 6, 2007**

(54) LABEL HAVING IMPROVED AESTHETIC APPEARANCE

(75) Inventors: Richard Spear, Cincinnati, OH (US); Richard Fearn, Milford, OH (US)

(73) Assignee: Spear USA, LLC, Mason, OH (US)

( * ) Notice: Subject to any disclaimer, the term of this patent is extended or adjusted under 35 U.S.C. 154(b) by 50 days.

This patent is subject to a terminal disclaimer.

(21) Appl. No.: 10/729,805

(22) Filed: Dec. 5, 2003

(65) Prior Publication Data

US 2004/0111941 A1 Jun. 17, 2004

Related U.S. Application Data

(60) Provisional application No. 60/433,414, filed on Dec. 13, 2002.

(51) Int. Cl.
*G09F 3/10* (2006.01)

(52) U.S. Cl. ..... 40/638; 40/616

(58) Field of Classification Search ..... 40/584, 40/616, 596, 599, 638, 299.1
See application file for complete search history.

(56) References Cited

U.S. PATENT DOCUMENTS 2,170,147 A * 8/1939 Lane ..... 206/447
2,351,933 A 6/1944 Decker et al.
3,791,841 A 2/1974 Camelini et al.
4,073,992 A 2/1978 Lerman et al.
4,219,596 A 8/1980 Takemoto et al.
4,391,853 A 7/1983 Pointon
4,404,764 A * 9/1983 Wills et al. ..... 40/124.11
4,935,300 A 6/1990 Parker et al.
4,977,006 A 12/1990 Smith et al.
5,104,719 A 4/1992 Kamen et al.
5,116,452 A 5/1992 Eder
5,215,622 A 6/1993 Schmelzer
5,284,688 A 2/1994 Hiatt
5,306,375 A 4/1994 Leonard
5,366,251 A 11/1994 Brandt et al.
5,421,933 A 6/1995 Nedblake et al.
5,464,495 A 11/1995 Eder (Continued)

FOREIGN PATENT DOCUMENTS

CA 2059108 1/1992

(Continued)

*Primary Examiner*—Cassandra Davis
(74) *Attorney, Agent, or Firm*—Thompson Hine LLP

(57) ABSTRACT

A label includes indicia disposed on a facestock comprising cellophane. In one embodiment, the indicia are screen printed onto the facestock. In another embodiment, the label may further include layers of tactile coating selectively applied to discrete areas of the facestock to create distinct raised portions on the label. The tactile coating may be applied to correspond to the location of the indicia, wherein the raised portions overlie the indicia. A separate layer of primer may be applied to the facestock to cover substantially an entire side of the facestock. A plurality of such labels may be provided in a stack to an automatic labeling machine for application to a series of containers. The label may be applied to a container and the raised portions of the label provide tactile feel which enhances the aesthetic qualities of the label and container.

11 Claims, 2 Drawing Sheets

U.S. PATENT DOCUMENTS 5,486,253 A 1/1996 Otruba
5,487,807 A 1/1996 Nedblake et al.
5,491,010 A 2/1996 Eder
5,512,122 A * 4/1996 Sokyrka ..... 156/275.5
5,516,393 A 5/1996 Freedman
5,585,193 A 12/1996 Josephy et al.
5,624,520 A 4/1997 Nedblake et al.
5,679,199 A 10/1997 Nedblake et al.
5,681,412 A 10/1997 Nedblake et al.
5,709,937 A 1/1998 Adams et al.
5,711,839 A 1/1998 Dronzek, Jr.
5,725,966 A 3/1998 Abe et al.
5,741,381 A 4/1998 Dolence et al.
5,741,387 A 4/1998 Coleman
5,753,350 A * 5/1998 Bright ..... 428/195.1
5,773,112 A 6/1998 Tachikawa et al.
5,779,482 A * 7/1998 Fukumoto ..... 434/113
5,779,919 A * 7/1998 DiPietro et al. ..... 216/4
5,843,549 A 12/1998 Mingus
5,857,275 A 1/1999 Deal
5,858,168 A 1/1999 Hinton
5,861,201 A 1/1999 Blackwelder et al.
5,902,449 A 5/1999 Moore
5,982,284 A 11/1999 Baldwin et al.
5,985,075 A 11/1999 Freedman
6,024,830 A 2/2000 Nedblake et al.
6,074,747 A 6/2000 Scholz et al.
6,083,620 A 7/2000 LaPrade et al.
6,099,927 A 8/2000 Freedman
6,099,944 A 8/2000 Laprade et al.
6,113,148 A * 9/2000 Koranda et al. ..... 283/81
6,127,032 A 10/2000 Kelch et al.
6,210,524 B1 4/2001 Josephy
6,242,510 B1 6/2001 Killey
6,267,598 B1 * 7/2001 Allen et al. ..... 434/112
6,270,871 B1 8/2001 Scholz et al.
6,287,671 B1 * 9/2001 Bright et al. ..... 428/195.1
6,299,956 B1 10/2001 Freedman
6,316,082 B1 11/2001 Tomkins et al.
6,694,652 B1 * 2/2004 Jeha ..... 40/615
6,857,211 B2 * 2/2005 Grasso ..... 40/310
2001/0035265 A1 11/2001 Dronzek
2002/0029635 A1 * 3/2002 Kremen ..... 73/426
2002/0095839 A1 * 7/2002 Allen et al. ..... 40/584

FOREIGN PATENT DOCUMENTS

EP 0 275 670 7/1988
EP 1 122 173 8/2001
EP 1 162 588 12/2001
FR 2559101 8/1985
GB 2 212 133 7/1989
GB 2 315 357 1/1998
JP 01250985 10/1989
JP 11065449 3/1999
WO WO 00/13888 3/2000
WO WO 00/63087 10/2000

* cited by examiner

LABEL HAVING IMPROVED AESTHETIC APPEARANCE

This application claims priority from Provisional Application Ser. No. 60/433,414 filed Dec. 13, 2002, the disclosure of which is fully incorporated herein by reference.

FIELD OF THE INVENTION

This invention relates to labels for containers, and more particularly to a label having improved aesthetic qualities.

BACKGROUND OF THE INVENTION

Printed labels are widely used on containers to identify the particular products, manufacturers, and brand names associated with the products in those containers. Conventional labels for containers include labels facestocks made from paper, films, and other polymeric materials. Paper-based labels typically have an opaque appearance, whereby the contents of the container are at least partially concealed from view. While paper-based labels are generally inexpensive, they are susceptible to damage, such as by abrasion or scuffing and generally exhibit poor adhesion in wet or humid environments. Opaque labels have also been made from polymeric materials, including thin films. While these materials offer improved resistance to scuffing and abrasion, as well as improved adhesion in humid conditions, opaque polymeric labels also conceal at least a portion of the product held within the container.

A recent trend in labeling containers has been towards utilizing clear thin film labels which provide a "label-less" or "printed-on" look. These labels have the advantages of improved resistance to scuffing and abrasion, and good adhesion in moist environments, and further provide improved aesthetic appearance of the containers to which they are applied. Both paper-based and polymeric labels are commonly imprinted with various graphics and text which may be applied to the labels by various methods including gravure printing, lithography, flexography, screen printing, and other methods suitable for creating the desired indicia on the labels.

Container labels described above have typically been provided in "cut-and-stack" form or roll form for application to containers by automated labeling equipment. In the cut-and-stack form, a plurality of individual labels are provided in a stack to a labeling machine, generally in a magazine, whereby the machine is configured to apply individual labels from the stack to containers as they are moved past a labeling station. The cut-and-stack labels may be provided with a pre-applied adhesive for securing the label to the containers, or the adhesive may be applied by the labeling machine immediately prior to affixing the label to the container. This method of supplying and applying labels to product containers has generally been utilized with paper-based labels.

Labels may also be provided in roll form wherein a plurality of discrete labels are provided on an elongate web of backing material that has been wound into a roll. The web of backing material is directed past a peel tip at a labeling station to transfer the label from the backing material to the individual product containers. This method of supplying labels to containers has typically been utilized with thin film and other polymeric labels. Adhesive is generally pre-applied to the labels and may be pressure sensitive or heat activated to adhere to the containers.

Polymeric labels, including thin film labels, have generally not been provided in cut-and-stack form due to various difficulties associated with providing polymeric labels in a stacked form. In particular, the polymeric materials are susceptible to developing static charges which cause the individual labels to cling to one another and to the labeling equipment, thereby hindering accurate and repeatable application of the labels to the product containers. Another factor which has hindered the provision of polymeric labels in stack form is that adhesives used in conventional cut-and-stack applications do not work well with polymeric materials. Furthermore, conventional cut-and-stack adhesives are not transparent. This is particularly problematic when the polymeric materials are transparent because the adhesives may be visible through the transparent label, thereby depreciating the aesthetic affects.

Labels provided to labeling equipment in cut-and-stack form may advantageously be applied to individual containers at very high rates, such as 1200 labels per minute or more. These high application rates are well suited for use with high-speed packaging lines. While the costs of polymeric labels, including thin film labels, has been gradually decreasing, paper-based labels are generally considered to be the least expensive labeling material. On the other hand, the polymeric-based labels, particularly clear, thin film labels, are generally associated with improved product appearance.

There is thus a need for a product label which provides improved aesthetic appearance, while being economically competitive to paper-based labels and capable of application to products in high speed manufacturing lines.

SUMMARY OF THE INVENTION

The features and objectives of the present invention will become more readily apparent from the following Detailed Description taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
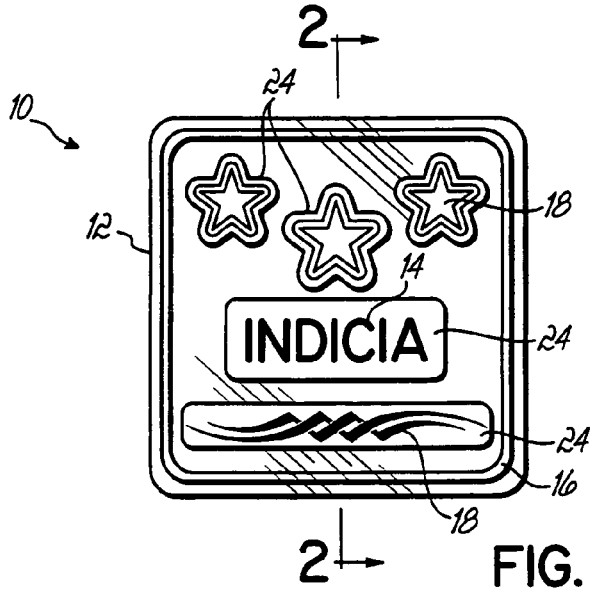
FIG. 1 is a plan view depicting an exemplary label of the present invention.

Referring to FIG. 1, there is shown an exemplary label 10 of the present invention. The label includes a facestock 12, which may be cut or otherwise formed into a discrete label shape, and visible indicia 14, 16, 18 selectively applied to a first side 20 of the facestock 12 to create letters, numbers, borders, decorative designs, or any combination thereof. In the exemplary embodiment, the facestock 12 is formed from cellulose material, commonly known as cellophane, but it will be understood that the facestock 12 may be formed from any other material suitable for making labels, such as paper or other polymeric materials, such as polyethylene, PVC or other suitable materials. The visible indicia 14, 16, 18 of the exemplary label 10 are created by applying ink to the facestock 12 by methods known in the art, such as screen printing, gravure printing, lithography, flexography, or any other method suitable method for creating the desired indicia 14, 16, 18. The indicia 14, 16, 18 may also include hot stamped foil or embossed images applied to the facestock 12.

Figure 2:
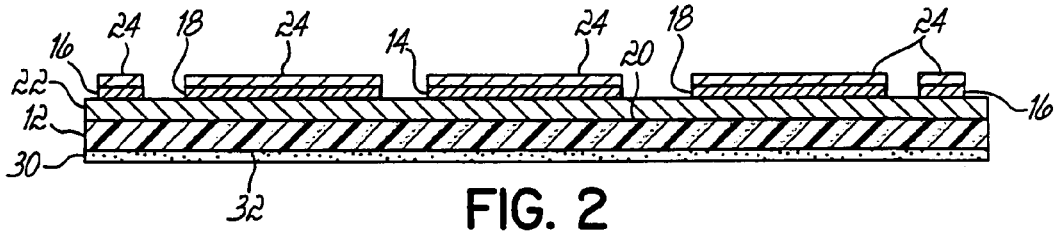
FIG. 2 is cross-sectional view of the label of FIG. 1, taken along line 2—2.

With further reference to FIG. 2, the exemplary label 10 also includes one or more layers of tactile coating 24 which are selectively applied to discrete areas of the first side of the facestock 12 to create distinct raised portions on the label 10. In the exemplary embodiment shown, the label 10 further includes a primer layer 22 applied to substantially cover the first side 20 of facestock 12, whereafter indicia 14, 16, 18 and selectively applied tactile coating layers 24 are applied to the facestock 12. Alternatively, the indicia 14, 16, 18 and tactile coating layers 24 may be applied to selected areas of the facestock 12 without first applying a primer layer 22 to cover the first side 20.

In the exemplary embodiment shown in FIGS. 1 and 2, the selectively applied tactile coating layers 24 are applied to areas proximate the indicia 14, 16, 18, whereby the areas overlying the indicia 14, 16, 18 are elevated with respect to the surrounding portions of the label 10. In the exemplary label 10, the primer layer 22 and the tactile coating 24 are UV cured acrylic coatings, such as Clear Extender No. 4929 available from Sun Chemical Corporation, Northlake, Ill., but other coatings suitable for application to a label and which can be applied in successive layers may be used as well.

With continued reference to FIG. 2, the label 10 further includes an adhesive layer 30 which is applied to a second side 32 of the facestock 12, generally opposite the first side 20 on which the indicia 14, 16, 18, primer 22, and tactile coating 24 are applied. Adhesive 30 may be applied to label 10 by the label manufacturer, or it may be applied immediately prior to application of the label to a container. When the labels are provided in "cut-and-stack" form, the labels are generally provided without adhesive and the labeling machine includes a station for applying the adhesive prior to application on the containers. The adhesive 30 may be a pressure-sensitive adhesive, heat-activated adhesive, water-activated adhesive, solvent-based, acrylic-based, or any other type of adhesive which is suitable for adhering a label 10 to a surface. In a preferred embodiment, the adhesive is transparent; adheres to glass, polymeric materials, and cellophane; sets quickly; and is relatively impervious to moisture and temperature fluctuations.

Figure 3:
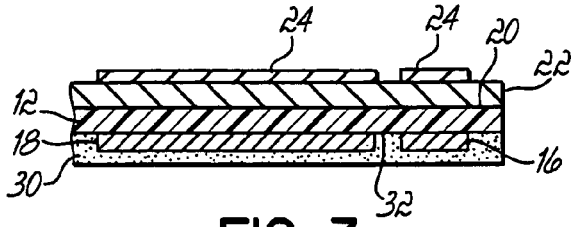
FIG. 3 is a cross-sectional view depicting another exemplary label of the present invention.

Referring to FIG. 3, there is shown another exemplary embodiment of the label 10 wherein the indicia 16, 18 are applied to the second side 32 of the facestock 12. When the facestock 12 is formed from a clear or partially transparent cellophane material, the indicia 16, 18 will be viewable from the first side 20 of the facestock 12. Accordingly, the images and lettering comprising the indicia 16, 18 will generally be applied to the second side 32 in reverse image so that they may be properly viewed from the first side 20. Advantageously, the clear cellophane material provides a protective barrier for the visible indicia 16, 18. In this embodiment, the tactile coating layers 24 may be selectively applied to discrete areas of the first side 20 of the facestock 12 to create the desired raised portions.

Figure 5:
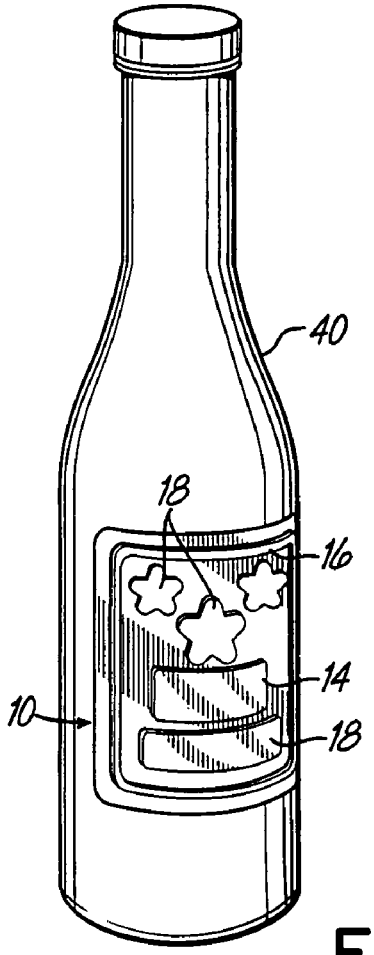
FIG. 5 is a perspective view of an exemplary container including a label of FIG. 1.

Referring to FIG. 5, there is shown an exemplary container 40 including a label 10 of the present invention. Advantageously, the raised portions of the inventive label 10 provide a tactile feel to the label 10 which is not present on prior art labels. The tactile feel may provide a gripping surface for a container 40 to which the label is applied, and/or may increase the aesthetic appearance of the labels 10. The label 10 may be applied to the container 40 by various means, such as automatic equipment configured to receive labels 10 provided in a stack, dispense individual labels 10 from the stack, apply adhesive to the labels 10, and apply the labels 10 to individual containers 40. Exemplary labeling machines useful for applying labels provided in stack form are the Promatic, Universella®, Variomatic, Robusta®, and Vinetta® labeling machines available from Krones, Inc., Franklin, Wis.

Figure 4:
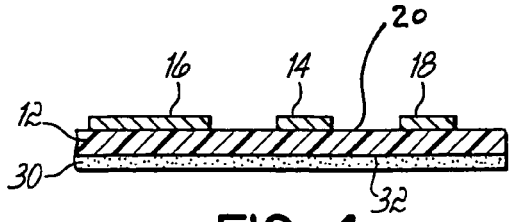
FIG. 4 is a cross-sectional view of another exemplary label of the present invention.

In another exemplary embodiment (FIG. 4), a label 10 according to the present invention comprises a facestock material 12 formed from cellophane that is cut, or otherwise formed into a discrete label shape. The facestock 12 has a first side 20 and a second 32 and visible indicia 16, 18 are screen printed to selective portions of one or both sides 20, 32 of the facestock 12, without tactile feel layers, to create letters, numbers, borders, decorative designs, or various combinations thereof. The label 10 may further include hot stamped foil or embossed images, borders, backgrounds, or designs applied to the facestock, as may be desired, to create various aesthetic effects. Adhesive 30 may be applied to the second side 32 of label 10 as pre-applied adhesive, or it may be applied prior to application of the label 10 to a container, as described above. Alternatively, adhesive 30 may be applied to the first side 20 of facestock 12, over the screen-printed indicia 16, 18. This construction may be used when the facestock 12 is at least partially transparent, whereby indicia 16, 18 printed in reverse image will be visible through the facestock 12.

Figure 6:
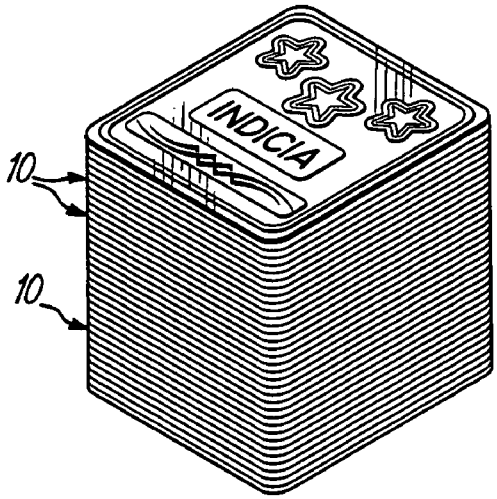
FIG. 6 is a perspective view of labels of FIG. 1 arranged in a stack.

These exemplary embodiments provide relatively low cost labels having improved aesthetic appearance. Advantageously, a plurality of labels constructed as described above may be provided in a stack, commonly referred to as "cut-and-stack" form (see FIG. 6), for dispensing and application to individual containers by a labeling machine.

An exemplary adhesive coated label 10 of the present invention may be made by applying visible indicia 16, 18 to a facestock 12 formed from cellophane. One or more tactile coating layers 24 may be applied to discrete areas of the facestock 12 to create distinct raised portions on the label 10. The indicia 16, 18 and tactile coating layers 24 may be applied to facestock 12 comprising an elongate sheet of cellophane, whereafter discrete label shapes are die cut using, for example, conventional equipment such as shown and described in the attached brochure.

While the present invention has been illustrated by the description of the various embodiments thereof, and while the embodiments have been described in considerable detail, it is not intended to restrict or in any way limit the scope of the appended claims to such detail.

Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of the general inventive concept

What is claimed is:

1. A label comprising:

a facestock layer having a first side and a second side;

printed visible indicia selectively applied to one or more portions of at least one of said first and second sides of said facestock layer; and at least one tactile coating layer selectively applied to discrete portions of said first side of said facestock layer to create distinct raised portions on the label for tactile feel;

wherein said label is divisible into individual sheets and disposed in a cut-and-stack configuration to render said individual sheets capable of application to a container by automated labeling machines.

2. The label of claim 1, further comprising a primer applied to said first side of said facestock layer.

3. The label of claim 1, wherein said tactile coating layer is applied to said first side of said facestock layer such that the location of said tactile coating layer substantially corresponds to the location of at least a portion of said visible indicia.

4. The label of claim 1, wherein said facestock layer comprises transparent cellophane.

5. The label of claim 1, wherein said visible indicia comprises screen printed ink.

6. A labeled product package, comprising:

a container having a surface for receiving a label; and a label disposed on said surface, said label comprising:

a facestock layer formed from cellophane and having a first side and a second side, printed visible indicia selectively applied to one or more portions of at least one of said first and second sides of said facestock layer, at least one tactile coating layer selectively applied to discrete portions of said first side of said facestock layer to create distinct raised portions on the label for tactile feel, and an adhesive layer applied to said second side of said facestock layer wherein said label is divisible into individual sheets and disposed in a cut-and-stack configuration to render said individual sheets capable of application to a container by automated labeling machines.

7. The labeled product package of claim 6, wherein said at least one tactile coating layer is selectively applied to said first side of said facestock layer such that the location of said tactile coating layer substantially corresponds to the location of at least a portion of said visible indicia.

8. The labeled product package of claim 6, further comprising a primer applied to said first side of said facestock layer.

9. A labeled product package, comprising:

a container having a surface for receiving a label; and a label disposed on said surface, said label comprising:

a facestock layer comprising cellophane and having a first side and a second side, visible indicia selectively screen printed to one or more portions of at least one of said first and second sides of said facestock layer;

at least one tactile coating layer selectively applied to discrete portions of said first side of said facestock layer to create distict raised portions on the label for tactile feel; and an adhesive layer applied to said second side of said facestock layer;

wherein said label is divisible into individual sheets and disposed in a cut-and-stack configuration to render said individual sheets capable of application to a container by automated labeling machines.

10. A supply of labels, comprising:

a plurality of discrete labels, wherein said labels are divisible into individual sheets and disposed in a cut-and-stack configuration to render said individual sheets capable of application to a container by automated labeling machines, each of said labels comprising:

a facestock layer formed from cellophane and having a first side and a second side;

printed visible indicia selectively applied to one or more portions of at least one of said first and second sides of said facestock layer, and at least one tactile coating layer selectively applied to discrete portions of said first side of said facestock layer to create distinct raised portions on the label for tactile feel.

11. The supply of adhesive coated labels of claim 10, wherein said labels further comprise a primer applied to said first side of said facestock layer.

* * * * *

UNITED STATES PATENT AND TRADEMARK OFFICE

CERTIFICATE OF CORRECTION

PATENT NO. : 7,185,453 B2
APPLICATION NO. : 10/729805
DATED : March 6, 2007
INVENTOR(S) : Richard Spear and Richard Fearn It is certified that error appears in the above-identified patent and that said Letters Patent is hereby corrected as shown below:

Column 6

Line 17 Change "distict" to -- distinct --.

Signed and Sealed this

Twenty-second Day of May, 2007

JON W. DUDAS
*Director of the United States Patent and Trademark Office*